US010711325B2

(12) United States Patent
Stoner et al.

(10) Patent No.: US 10,711,325 B2
(45) Date of Patent: Jul. 14, 2020

(54) PRODUCTION OF COPPER-67 FROM AN ENRICHED ZINC-68 TARGET

(71) Applicant: Idaho State University, Pocatello, ID (US)

(72) Inventors: Jon Stoner, Pocatello, ID (US); Tim Gardner, Firth, ID (US)

(73) Assignee: Idaho State University, Pocatello, ID (US)

( * ) Notice: Subject to any disclaimer, the term of this patent is extended or adjusted under 35 U.S.C. 154(b) by 168 days.

(21) Appl. No.: 15/922,663

(22) Filed: Mar. 15, 2018

(65) Prior Publication Data

US 2018/0209013 A1 Jul. 26, 2018

Related U.S. Application Data

(62) Division of application No. 14/819,271, filed on Aug. 5, 2015, now Pat. No. 10,006,101.

(60) Provisional application No. 62/035,113, filed on Aug. 8, 2014.

(51) Int. Cl.

| | |
|---|---|
| ***C22B 15/00*** | (2006.01) |
| ***G21G 1/00*** | (2006.01) |
| ***G21G 1/12*** | (2006.01) |

(52) U.S. Cl.

CPC ..... *C22B 15/00* (2013.01); *G21G 1/001* (2013.01); *G21G 1/12* (2013.01); *G21G 2001/0094* (2013.01)

(58) Field of Classification Search

CPC ..... C22B 15/00; G21G 1/00; G21G 1/12

See application file for complete search history.

(56) References Cited

U.S. PATENT DOCUMENTS

| | | | | |
|---|---|---|---|---|
| 5,279,745 | A | 1/1994 | Jeffers et al. | |
| 8,526,561 | B2 | 9/2013 | Ehst et al. | |
| 9,312,037 | B2 | 4/2016 | Ehst et al. | |
| 10,006,101 | B2 * | 6/2018 | Stoner | G21G 1/001 |
| 2017/0251547 | A1 * | 8/2017 | Ito | G21G 1/04 |
| 2018/0209013 | A1 * | 7/2018 | Stoner | G21G 1/001 |

OTHER PUBLICATIONS

AIP Conference Proceedings article "Copper-67 production on electron linacs—Photonuclear technology development" Ehst et al, Dec. 2012 (Year: 2012).*

Ehst et al, "Copper-67 Production on Electron Linacs Photonuclear Technology Development," Argonne National Laboratory, 1pg.

Fritze,"The Preparation of High Specific Activity Copper 64," McMaster University, Ontario, May 8, 1964, pp. 166-167.

Marceau et al, "The Production of Copper 67 from Natural Zinc Using a Linear Accelerator," International Journal of Applied Radiation and Isotopes, vol. 21, 1970, pp. 667-669.

(Continued)

*Primary Examiner* — Scott R Kastler

(74) *Attorney, Agent, or Firm* — Dority & Manning, P.A.

(57) ABSTRACT

An apparatus including a heating element and a sublimation vessel disposed adjacent the heating element such that the heating element heats a portion thereof. A collection vessel is removably disposed within the sublimation vessel and is open on an end thereof. A crucible is configured to sealingly position a solid mixture against the collection vessel.

8 Claims, 13 Drawing Sheets

(56) References Cited

OTHER PUBLICATIONS

Office action for U.S. Appl. No. 14/819,271, dated Oct. 12, 2017, Stoner, "Production of Copper-67 from an Enriched Zinc-68 Target", 6 pages.
Smith et al, "Production and Separation of 67Cu at Argonne National Laboratory," Argonne National Laboratory, Isotope Production: Past, Present and Future: Symposium in Honor of Michael J. Welch 245th ACS National Meeting and Exposition, Apr. 7-11, 2013, New Orleans, Louisiana, 20pgs.
Smith et al, "The Production, Separation, and Use of 67Cu for Radioimmunotherapy: A Review," Applied Radiation and Isotopes, Jul. 17, 2012, pp. 2377-2383.
Starovoitova et al, "Cu-67 Photonuclear Production," American Institute of Physics, Jun. 2011, 4pgs.

* cited by examiner

PRODUCTION OF COPPER-67 FROM AN ENRICHED ZINC-68 TARGET

CROSS REFERENCE TO RELATED PATENT APPLICATIONS

This application is a divisional of, and claims priority to, U.S. patent application Ser. No. 14/819,271, filed Aug. 5, 2015, entitled "Production of Copper-67 from an Enriched Zinc-68 Target," now issued as U.S. Pat. No. 10,006,101, which claims priority to U.S. Provisional Patent Application No. 62/035,113, filed Aug. 8, 2014, entitled "Production of Copper-67 from an Enriched Zinc-68 Target," the entire contents of both of which are incorporated herein by reference.

BACKGROUND

This application is related to a method and apparatus for the production of radiopharmaceutical copper-67. Further, the application describes a sublimation apparatus and target assembly of the sublimation apparatus used to improve the methods of producing copper-67.

Nuclear medicine is a branch of medicine that relies on radiation to both diagnose and treat a variety of conditions, including many types of cancers, heart diseases, and other disorders. Within nuclear medicine, diagnostic or imaging techniques use radioisotopes that are either gamma or positron emitters. Typically, the majority of medical procedures involving radioisotopes are for diagnostic applications. A smaller percentage of the procedures are for therapeutic purposes. In either case, these radioisotopes are relatively short-lived (i.e., a short half-life) and are linked or conjugated to chemical compounds known as radiopharmaceuticals.

A radiopharmaceutical preferably binds to one or more sites of a tissue or cancer cell. As many cancer cells have a limited number of available binding sites, the administration of a non-labeled bio-conjugate will often times block one or more of the cellular sites. Therefore, radioisotopes used in the labeling of a bio-conjugate preferably have high specific activity to minimize the attachment of non-labeled bio-conjugates that have little to no therapeutic or diagnostic effect. With the use of a gamma-detecting camera, radiopharmaceuticals are used to construct 3-D images of different organs and tissues, thereby providing information on organ function or disease. This data may in turn be used for reliable and accurate medical diagnosis.

One such radiopharmaceutical, copper-67, has a half-life of about 62 hours, and has a gamma-ray energy suitable for imaging. Copper-67's beta particle is also of sufficient energy for therapy with a cell range of less than 2 mm and the gamma ray is detectable using a SPECT camera. In addition, the chelation chemistry of copper is well established and copper is well tolerated by the body, particularly at the trace levels administered to patients. Furthermore, a copper-67 radiopharmaceutical has sufficient range to target and irradiate small tumors without damaging surrounding healthy tissue. Copper-67 has been used in studies to treat non-Hodgkin's lymphoma and shows promise in treating many types of cancer. The half-life of copper-67 also delivers a low systematic radiation dose to the patient and allows for its transportation from a generation facility to a medical center or research laboratory.

Methods for producing copper-67 have included nuclear reactors and bombarding zinc oxide with high energy protons. Like reactor generation, producing copper-67 using high energy proton accelerators has high inherent capital and operational costs, scheduling issues, and product contamination risks. The specific activity of copper-67 from proton production methods also exhibit wide variability. As nuclear medicine continues to be an important part of non-invasive disease diagnosis and treatment, there exists the need to produce copper-67 without the described drawbacks.

BRIEF DESCRIPTION OF THE DRAWINGS

The Detailed Description is set forth with reference to the accompanying figures. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size, while other figures may depict the same components on a larger scale for the sake of clarity.

DETAILED DESCRIPTION

Overview

Figure 1A:
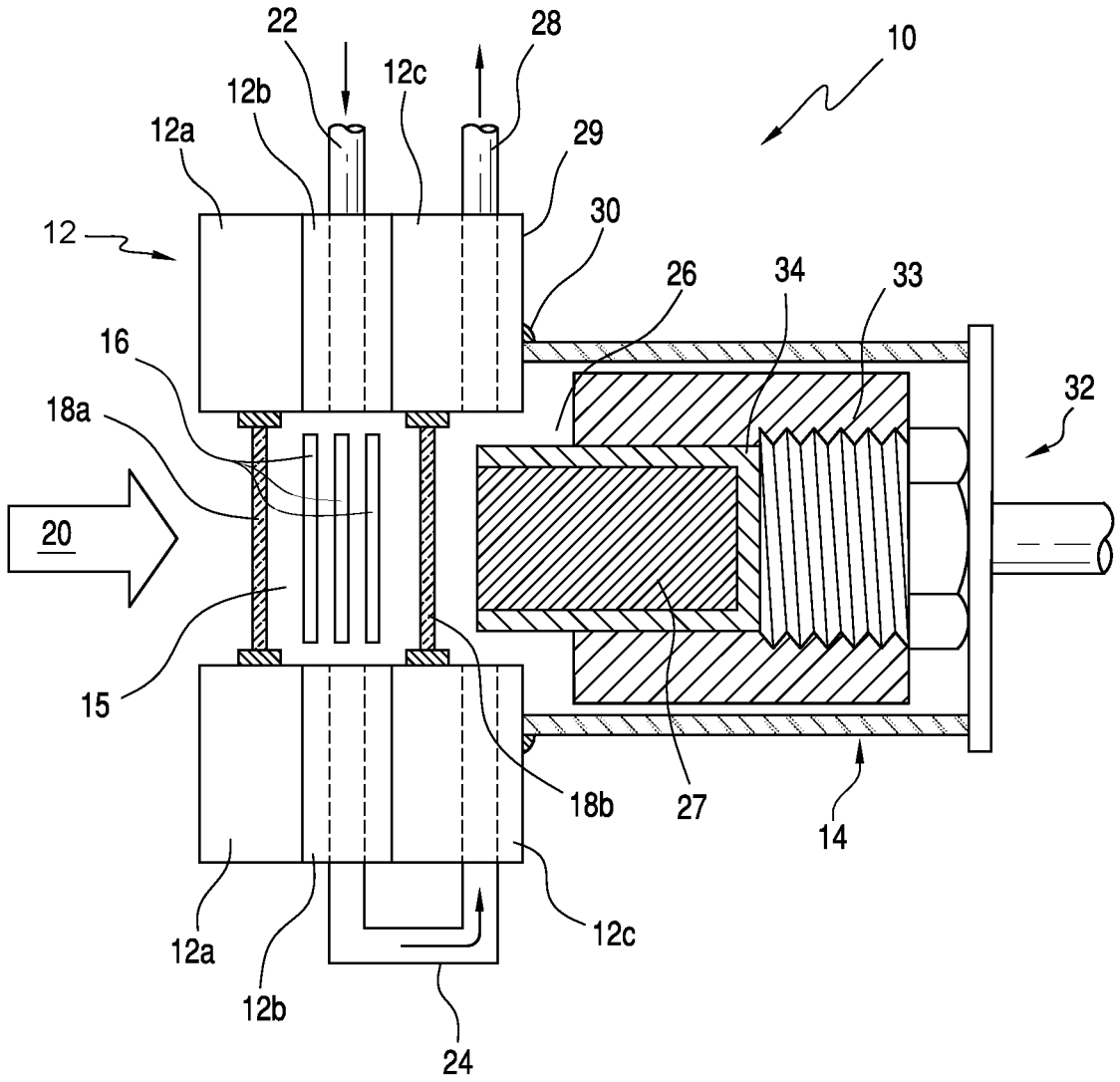
FIG. 1A illustrates a cross-sectional view of an example target assembly used in the irradiation of an enriched metal target.

The current disclosure is directed towards a method of producing radioisotopes and a sublimation assembly, apparatus, and vessel used for producing and isolating radioisotopes, for example, copper-67. In one embodiment, the copper-67 may be produced with a purity, specific activity, and consistency suitable for diagnostic and therapeutic applications. The description itself is not intended to limit the scope of this patent. Rather, the inventors have contemplated that the claimed invention might also be embodied in other ways, to include different elements or combinations of elements similar to ones described in this document, in conjunction with other present or future technologies.

As used herein, beam energy contains the units MeV, current is described in microAmps, and the power of the beam is expressed as kW.

Sublimation is a separation and purification technique for inorganic solids. In general, the separation of an inorganic mixture using sublimation includes placing a solid mixture in a flask positioned within a heating element. Located above the flask is a condenser, which may include a continuous flow of water or other coolant fluid. At times, the condenser may comprise a hollowed and exposed inner volume in which a dry-ice slush bath may be used to cool the condenser. The flask containing the mixture may be heated to a select temperature, and the interior volume of the sublimation apparatus may be placed under a dynamic vacuum. The inorganic component with a greater vapor pressure at the given temperature of the solid mixture and the pressure of the sublimation apparatus may therein condense upon a solid surface of the condenser. Following a certain period of time, the heat may be removed from the flask, and thereafter the condenser removed. The separated, and typically the desired, inorganic component may then be scrapped from the surface of the condenser.

In one embodiment, the sublimation apparatus may generally include a support to position a solid mixture within the sublimation vessel and a collection vessel. The sublimation vessel may generally have a heat volume portion configured to fit within a region of a heating element, and a warm volume portion that extends from the heat volume portion to a location outside of the region of the heating element. The collection vessel may include an upper end and an opposite, open end, with an internal sidewall extending from the upper end to the opposite open end, thus forming an internal volume to the collection vessel. Upon applying heat to the sublimation vessel via a heating element, for example, and consequently heating the solid mixture positioned within the heat volume portion of the sublimation vessel, one or more metal vapors may condense upon the internal sidewall, causing the metal vapors to collect within the internal volume of the collection vessel.

Furthermore, described is a method for producing the radioisotope, copper-67, from an isotope-enriched metal target comprising zinc-68, hereafter referred to a "zinc-68 target," a "metal target," or a "target." The method of separation may include positioning a solid mixture comprising copper-67 and zinc-68 in a sublimation apparatus. The sublimation apparatus may include, for example, the previously described structure. The method may incorporate heating the solid mixture to a temperature sufficient to form metal vapor comprising greater than 90% by weight zinc-68. The heated metal vapor thereafter may condense within the internal volume of the collection vessel and onto the internal sidewall. Condensation may occur as zinc-68 has an appreciable vapor pressure at a temperature from 300° C. to 700° C. and at a nominal pressure of $10^{-5}$ mbar within the sublimation vessel.

The method of producing copper-67 may begin by positioning the zinc-68 target in a target assembly and directing an electron beam with an energy of at least 20 MeV and an average power of at least 1 kW, onto a first in a series of at least three, substantially parallel Bremsstrahlung converter plates.

As discussed within the instant application, Bremsstrahlung refers to electromagnetic radiation produced by high energy electrons deflected (decelerated) in an electric field of another charged particle, such as an electron or atomic nucleus. A Bremsstrahlung converter is a material that produces Bremsstrahlung radiation when high energy electrons strike the converter, thereby converting electron energy into photon energy.

Typically, converter plates are made from materials with high atomic numbers as the Bremsstrahlung radiation's efficiency increases with the energy of incident electron, the atomic number, and thickness of the target material. For example, tungsten and tantalum both have relatively high electron-photon conversion rates, high melting points, and may withstand high electron power densities. Therefore, converter materials include, but are not limited to, tungsten, tantalum, or heavier metals, such as osmium.

Independently, each of the at least three converter plates may have a thickness between 0.75 mm to 3.0 mm and a minimum plate separation between 1 mm and 4 mm. The use of three converter plates may generate sufficient Bremsstrahlung radiation that impacts the zinc-68 target over a period of time. For example, and without limitation, the period of time may be at least 1 hour. As specific activity of a radioisotope is typically reported in units of activity per unit mass (Curies/gram), the above configuration and dimensions may produce a solid mixture with a measured activity of copper-67 of at least 1 μCi/g-target.

Alternatively, if a single converter plate is used, the plates may have a thickness in the range of about 2 mm to about 8 mm about, 2 mm to about 5 mm, or about 2 mm to about 3 mm. Similarly, the converter plates may be tungsten, tantalum, tantalum-coated tungsten plates, or another heavy z-metal, such as osmium.

The multi-converter plate may be designed to stop high energy incident electrons and prevent the photo-production target from excessive heating by absorbing low energy electrons that may otherwise deposit thermal energy into the metal target. To minimize the pass through of electrons and subsequent heating of the metal target, it is possible to increase the total thickness of the converter. However, an increase in converter thickness may result in a decrease in the average photon flux at the energy of maximum production within the zinc-68 target and may produce lower photo-yields of the desired radioisotope, for example, copper-67. Alternatively, a decrease in converter thickness may increase photon flux at the energy of maximum production in the metal target but may increase target heating by allowing a large portion of the electrons to penetrate through the converter plates and into the target.

The spacing between the converter plates may be organized to keep the turbulence of the water flowing between the plates in order to maximize the heat removal. The thicker the plates or, alternatively, the thicker the water between the plates may potentially shield the gamma rays and decrease the overall yield of the metal target. For example, it may not be suitable to have different spacing between the plates, respective of one another, because the water may find the least resistance within the assembly and the narrowly spaced plates may have insufficient water flow and overheat. Furthermore, the farther away the metal target is from the converter, the less "concentrated" the gamma-ray beam may become. Consequently, the concentration of the gamma-ray energy may be represented by $1/R^2$, where R is the distance away.

While multiple converter plates provide heat removal by water, or similar coolant fluids, further embodiments may rid such features as water in the converter may block the electrons and gamma rays targeted for the metal target. Accordingly, converter designs such as a liquid metal converter made from lead bismuth eutectic (LBE) may be incorporated into the target assembly. Therefore, such converter designs may run at high power and dissipate heat without water flow in the converter.

An optimum Bremsstrahlung converter design, for example, is one that may produce maximum high energy Bremsstrahlung photons above 10 MeV for photo-nuclear reactions. A Bremsstrahlung converter may have multiple stacked converter plates in series to improve production yields of copper-67. If multiple stacked converter plates are used, the total thickness of all converter plates may have a thickness in the range of about 2 mm to about 8 mm, about 2 mm to about 6 mm, or about 2 mm to about 4 mm.

The separation of electron linear accelerator (linac) generated copper-67 from a bulk zinc-68 target may require separating small, near trace amounts of copper-67 from the solid target mixture. For example, the mass of non-converted zinc-68 in the solid mixture may be seven to nine orders of magnitude greater in mass than the copper-67. Accordingly, the separation process may account for the dilution of copper-67 in the solid mixture, and therefore, minimize the loss of the very small amounts of copper-67 in the solid mixture. In other words, one of the technical problems that may be addressed is the select separation and isolation of the small amounts of copper-67 in the solid mixture.

Photonuclear production of copper-67 using an electron linac represents an alternative to proton and neutron induced production methods. When high energy photons are absorbed by a nucleus of the target material, the nucleus becomes unstable. The unstable nucleus may then release excess energy in the form of one or more particles, e.g., proton, neutron, $\alpha$, $\beta$, or $\gamma$, etc., and decays to a lower energy state. This process may be expressed as: $T+\gamma \rightarrow P+b$, wherein, T represents the target nucleus, $\gamma$ the incident radiation particle, e.g., a gamma ray, P the product nuclide, and b, the emitted particle. As stated, the use of electron linacs for copper-67 production is a convenient and relatively inexpensive alternative to nuclear reactor and proton accelerators.

The described sublimation and purification methods may have copper-67 recovery yields of at least 80%, at least 90%, at least 95%, or at least 98%. The process of copper-67 production and improved efficiencies in the separation and isolation of copper-67 described may address and provide answers to many technical and commercial issues.

To produce high concentrations of copper-67 in an irradiated target, the power of the electron beam or the irradiation time may be increased. Therefore, a relationship may exist between the average power of the electron beam used to irradiate a zinc-68 target and the time of irradiation in an irradiated target. Additionally, in a photon induced reaction, the yield of radioisotopes may be increased by increasing the production rate, which may, in part depend, upon the photon flux, the number of target atoms, and the cross section of the radiation induced photo-nuclear reaction. The number of Bremsstrahlung photons created using an electron linac may depend on electron beam parameters, such as electron energy, current, beam divergence, and beam size. Likewise, different converter materials and design may affect efficiencies of electron to photon conversions.

Additionally, a metal target may not be only subjected to irradiation from gamma rays, but also irradiation from gamma and electrons of insufficient energy to cause photo-conversion. Moreover, a photo-production metal target may be also subjected to irradiation from primary and secondary electrons from the electron beam. The metal target may therefore absorb power delivered by both incident electrons and photons, resulting in additional heat generation. Accordingly, there exists an appropriate balance between electron beam power and the amount of heat dissipated. Also, since radioisotope yields are proportional to the incident beam power, the power density from gammas and secondary electrons in the target may be maximized to increase isotope production yield. Still, the target may be limited to maximize the photon flux within the target. In both instances, the maximization of electron beam power and photon flux may increase the thermal power density in the target. Accordingly, if the melting point of target materials is low, the target may melt, and in some instances boil, unless sufficient cooling exists.

To optimize and balance irradiation parameters, Monte-Carlo simulations may be used to model both the optimum photon flux and power deposition into a zinc-68 target. The photon flux may be calculated by utilizing standard MCNPX volume-averaged flux for a 40 MeV electron energy beam. Also, the total energy deposited by electrons and photons on the metal target and converter plates may be simulated using energy deposition tally of MCNPX. In an embodiment, because of its high atomic number, high density (19.3 $g/cm^3$), and very high melting point (3422° C.), tungsten may be selected for the converter material of converter plates. It may also be advantageous to coat converter plates with tantalum to impart additional chemical stability.

While there may exist no limit to production yields regarding how high an average beam power may be used, practical limitations exist to prevent partial melting, or perhaps, partial vaporizing of the target. For a zinc-68 target of about 30 g to about 50 g, a suitable average beam power may be tens of kilowatts, e.g. from about 5 kW to about 40 kW.

To optimize photon flux distribution through the zinc-68 target, the appropriate size and shape of the target may maximize the integral flux, and correspondingly, the overall photo-yield of copper-67. A study in system parameters such as the beam energy (MeV), current (microAmps), and hence the power of the beam (kW), may maximize the photo-yield. However, there exists an operational balance to control the electron beam because of heat generation in the zinc-68 target. Therefore, a target assembly equipped with a cooling design may moderate the anticipated increase in temperature of the target, converter, and/or assembly.

A given target metal is commonly composed of many isotopic species. For example, the isotopic amount of zinc-68 in natural zinc may be about 19%. The desired radioisotope generated by the photo-production process is the result of a gamma photoreaction with a specific isotope of the target metal. As indicated, in the case of the photoreaction to produce copper-67, the target metal is zinc, and the isotope of interest is zinc-68. If natural zinc is irradiated in a photo-production process, the other isotopes of zinc may be converted into unwanted or contaminating species, some of which may be radioactive. Accordingly, the use of a target enriched in the isotope of interest, i.e., the isotope that is converted to the desired radioisotope, may result in an increase in photo-yield and a reduction in contaminating species. However, isotopic enriched targets may be expensive and since only a small portion of the target metal may be converted into the desired radioisotope, it may be necessary to develop a process to recover the unconverted enriched target metal. For example, photoreaction using Bremsstrahlung may often convert a small amount of a target isotope to the radioisotope of interest—as little as nanograms of radioisotope per gram of target.

For these reasons, the zinc-68 target to be irradiated may be enriched in zinc-68 by at least about 90%, at least about 95%, and even at least about 99%. For example, the zinc-68 target obtained may comprise an enrichment of greater than 95% zinc-68, greater than 97% zinc-68, greater than 99% zinc-68, greater than 99.9% zinc-68 or even greater than 99.99% zinc-68. It may also be advantageous for the zinc-68 target to have trace copper impurities removed in order to minimize the amount of cold copper (non-copper-67) recovered in the separation process following irradiation (described in further detail herein). Highly enriched zinc-68 targets that contain low levels of cold copper may be obtained by repeated sublimation of the zinc-68 target.

The recycling of the zinc-68 target may have an advantage in that the amounts of cold copper and other trace metal contaminants in the enriched zinc-68 target may reduce with each successive recycle. Accordingly, when a certain amount of Cu-67 is produced, the target may have few impurities of cold copper, accounting for a higher ratio of Cu-67 to cold copper or other impurities, as compared to a target that may not have been successfully sublimated or recycled. Therefore, it may be possible to obtain radioactive copper samples for medical applications with a higher ratio of copper-67 to non-radioactive (cold) copper after each zinc target recycle stage.

From a theoretical perspective, the actual mass size of the zinc-68 target to be irradiated with Bremsstrahlung may not be limited, however, from a technical perspective, the zinc-68 target may have a mass size, for example, in the range of about 10 g to about 1000 g, 80 g to 300 g, or 10 g to about 60 g. Albeit, it is understood that smaller and larger sized targets may also be irradiated.

To optimize operational system parameters in the production of a high specific activity product comprising copper-67, an investigation may be conducted to determine the following: the optimum electron beam energy for a given electron linac, keeping in mind that electron beam energy also has an effect on the maximum beam current; the design of the Bremsstrahlung converter in terms of material as well as geometry to maximize photon flux within the zinc-68 target; and the zinc-68 target geometry to maximize photon flux through the target.

It is understood that a change or optimization of one operation parameter may, in turn, affect at least one of the other operational parameters. Therefore, an appropriate "tradeoff" when optimizing any one operational parameter may be assessed and analyzed.

DETAILED EXPLANATION OF THE COMPONENTS IN THE FIGURES

Referring to the figures, FIG. 1A illustrates a cross-sectional view of target assembly 10. Target assembly 10 may comprise a front housing 12 that includes a first section 12*a*, a second section 12*b*, and a third section 12*c*, the latter being joined to rear housing 14. Front housing sections 12*a* and 12*b* may be assembled and disassembled to allow access to plate cavity 15 and Bremsstrahlung converter plates 16.

The first section 12*a* of the front housing 12 may include a front window fitting to seal front target window 18*a*. Likewise, the third section 12*c* of the front housing 12 may include a rear window fitting to seal rear target window 18*b*. Collectively, target windows 18*a* and 18*b* may allow access to plate cavity 15, which encloses converter plates 16. Front target window 18*a* may be made of any material that has little or no effect on electron beam 20, which passes through target front window 18*a*. Similarly, rear target window 18*b* may be made of any material that has little or no effect on the produced gamma photons, which also passes through rear window 18*b*.

Converter plates 16 and metal target 27 may be configured in any suitable manner within electron beam 20. To remove heat generated in converter plates 16 by the impact of electron beam 20, the second section 12*b* of the front housing 12 may include coolant fluid input 22. The coolant fluid, for example water, may be added through coolant fluid input 22 at a select rate (volume/min) and enter plate cavity 15 to remove heat generated in converter plates 16. After passing around or between converter plates 16, the coolant fluid may be diverted to the third section 12*c* of the front housing 12 through conduit 24 (the coolant flow in FIG. 1A is represented by the depicted arrows). Thereafter, the coolant flow may be directed to target cavity 26, pass through target cavity 26, and then exit out coolant fluid output 28. In this configuration, the coolant fluid may remove heat generated in metal target 27 during irradiation. While FIG. 1A depicts one embodiment of a target assembly, alternative target assembly designs may provide similar irradiation conditions, for example, photon flux or coolant flow. Furthermore, it is conceivable, for example, that another coolant design may have two separate coolant fluid inputs and two corresponding outputs.

Within target assembly 10, rear housing 14 is joined to back end 29 of the third section 12*c* of the front housing 12. For example, rear housing 14 may be joined via welding to back end 29 at joint 30. Rear housing 14 may be mechanically configured to be sealed by back-plate target plunger assembly 32 (including a back plate that opens and closes by the plunger), which in turn may be releasably attached to target crucible support 33. Target crucible support 33 may be mechanically configured to releasably attach to and from target crucible 34. Accordingly, one may mechanically manipulate back-plate target plunger assembly 32 to position target crucible 34, and hence, the metal target 27 in and out of target assembly 10. In one embodiment, rear housing 14 may be cylindrical.

Metal target 27 may be configured in any geometric form for irradiation. For example, metal target 27 may be configured in the form of one or more plates or a solid cylinder. Metal target 27 may be positioned in target crucible 34 and then positioned within a target assembly 10, thereafter being irradiated with gamma rays produced by converter plates 16. The gamma rays may have an intensity of at least about 1.5 $kW/cm^2$ to about 20 $kW/cm^2$. For example, an arrangement of converter plates 16 may produce gamma rays with an intensity of from about 3 $kW/cm^2$ to about 14 $kW/cm^2$ or from about 3 $kW/cm^2$ to about 8 $kW/cm^2$.

Figure 1B:
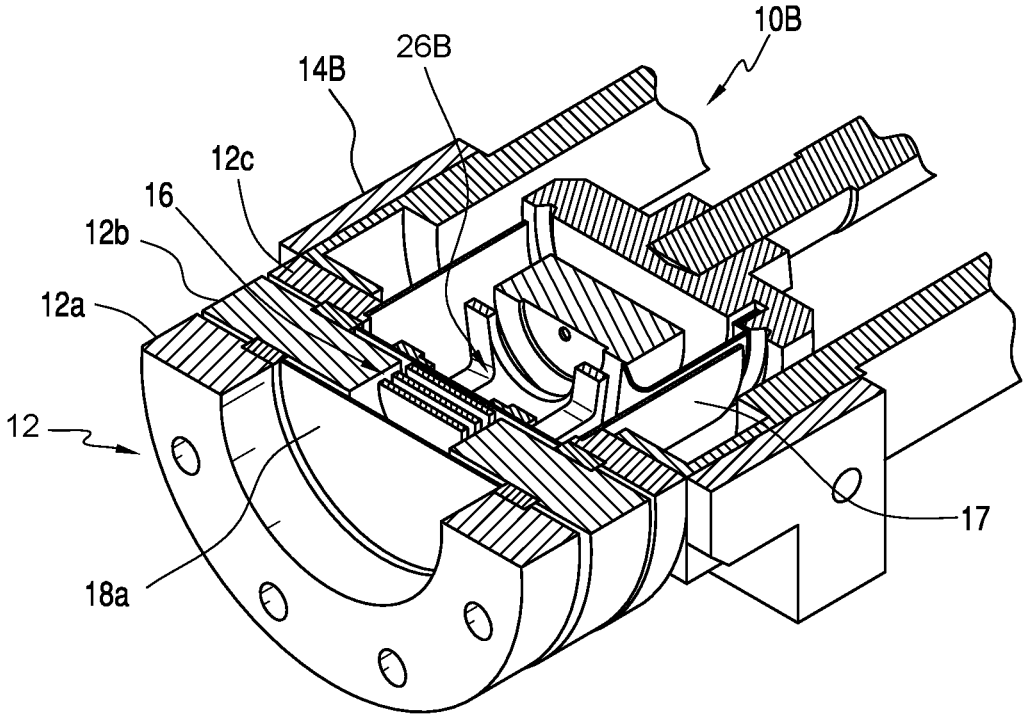
FIG. 1B illustrates a cross-sectional view of another example target assembly used in the irradiation of an enriched metal target.

FIG. 1B illustrates a cross-sectional view of another embodiment of a target assembly 10B. Similar to target assembly 10 in FIG. 1A, target assembly 10B includes a front housing 12 that may include a first section 12*a*, a second section 12*b*, and a third section 12*c*, the latter being joined to rear housing 14B. The first and second sections, 12*a* and 12*b* of housing 12, may be assembled and disassembled to allow access to target cavity 26B and converter plates 16. First section 12*a* of housing 12 may include a front window fitting to seal a front target window 18*a*. Target assembly 10B may also include a coolant flow system (not shown, but may be similar to the system of coolant fluid input 22 in FIG. 1A) for cooling the converter plates 16 and the metal target (not shown). For example, water or another coolant fluid may be used to remove heat from the metal target when positioned in target cavity 26B. The coolant fluid may be contained within target housing 17. Target housing 17 may also include an input and output (not shown) so the coolant fluid may flow into housing 17, around a metal target positioned in target cavity 26B, and exit out of housing 17.

An arrangement of three in series converter plates 16 shown in FIG. 1B may produce gamma rays with an intensity of from about 4 kW/cm$^2$ to about 6 kW/cm$^2$. In one example, converter plates 16 made of tungsten may be irradiated with an electron beam (such as electron beam 10 of FIG. 1A) having a beam energy in the range of about 25 MeV to about 100 MeV, e.g., 35 MeV to 55 meV, and a beam current in the range of about 30 microAmps to about 280 microAmps, e.g., 50 microAmps to 140 microAmps. The irradiation of converter plates 16 with the electron beam may result in the production of gamma rays with energies in the range of about 1 MeV to about 55 MeV, e.g., of about 1 MeV to about 40 MeV. For example, in some instances and for medical applications, the irradiation may be continued until the conversion to copper-67 yields a copper-67 total activity of at least about 2 μCi/g-target, at least about 5 μCi/g-target, at least about 10 μCi/g-target, or at least about 20 μCi/g-target. For example, when using a 40 g zinc-68 target (such as target 27 (FIG. 1A)), one may irradiate the metal target with Bremsstrahlung-produced gamma rays for a time until at least about 80 μCi of copper-67, at least about 400 μCi of copper-67, or at least until about 800 μCi of copper-67, is produced. In one instance, for example, one may irradiate a 40 g zinc-68 target with Bremsstrahlung-produced gamma rays for a time until from about 500 μCi to 500 mCi of copper is produced.

Alternatively, a target assembly may provide a yield of copper-67 of at least about 5 μCi/g-target-kW-hr of beam energy, at least 20 μCi/g-target-kW-hr of beam energy, or at least about 50 μCi/g-target-kW-hr of beam energy. Irradiation times may be, for example, in the range of about 1 hour to 260 hours, 10 hours to 140 hours, or 40 hours to 96 hours.

Figure 1C:
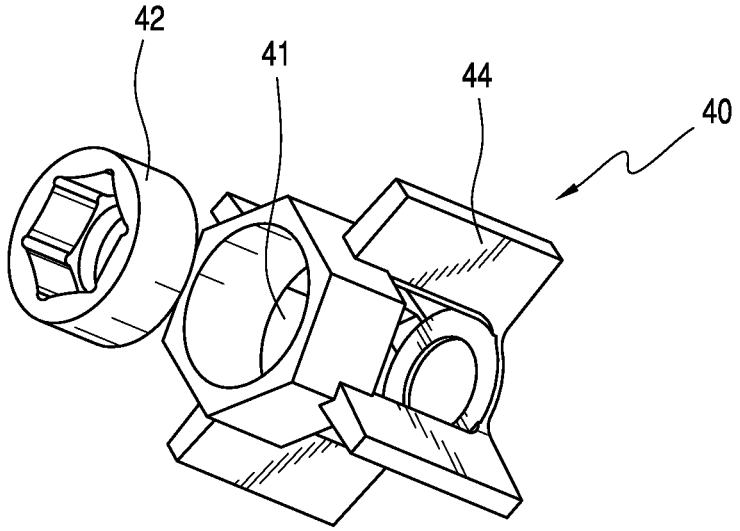
FIG. 1C illustrates an isometric view of a target holder within a target assembly.

FIG. 1C illustrates a target holder 40 for insertion within target cavity 26 of FIG. 1A or target housing 17 of target assembly 10B, for example. Target holder 40 may hold a metal target, such as metal target 27 in FIG. 1A, contained within a target crucible, such as target crucible 34. Although depicted as cylindrical, the target holder 40 may take any shape. In use, a target crucible containing a metal target may be positioned within internal volume 41 of target holder 40 and may be held in place with threaded plug nut 42. Target holder 40 may also include any number of cooling fins 44 to facilitate the transfer of heat from the metal target to the coolant fluid that flows through target cavity 26 of FIG. 1A or target housing 17 of FIG. 1B.

Figure 2:
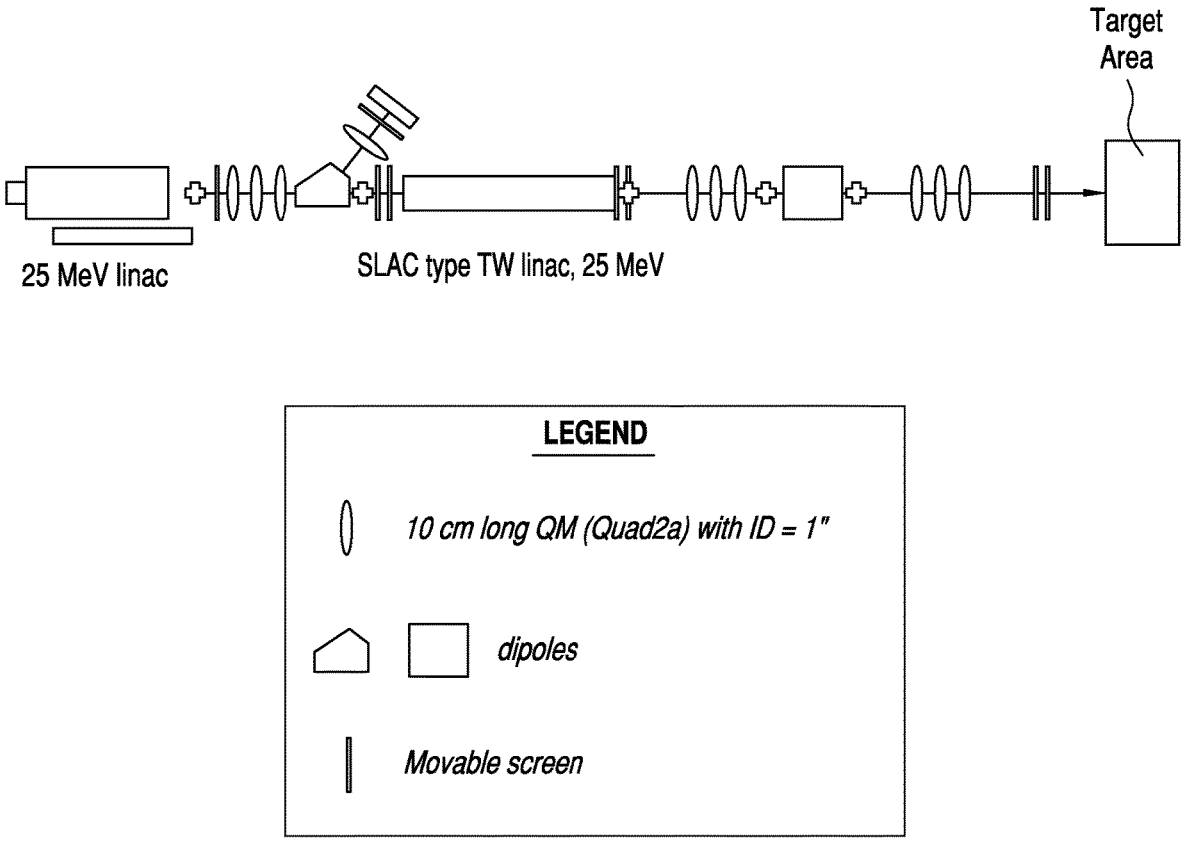
FIG. 2 illustrates a schematic of an electron linear accelerator (linac) used to irradiate an enriched metal target.

FIG. 2 is a schematic of an electron linear accelerator (linac) that may be used for producing photonuclear copper-67 from a zinc-68 target. Depicted within FIG. 2, quadrapole magnets (denoted 10 cm long QM (Quad2a)) may be used to help focus the electron beam down an axis of the accelerator. Dipole magnets may be included to allow the electron beam to be turned, and therefore to determine the energy of the electron beam. Additionally, moveable screens may be used to determine the size of the beam inside the accelerator tube. Corresponding to the schematic illustrated in FIG. 2, the total unloaded output energy may be about 50 MeV, with an energy reduction 0.118 MeV/microAmps of peak beam current after beam loading.

Figure 3:
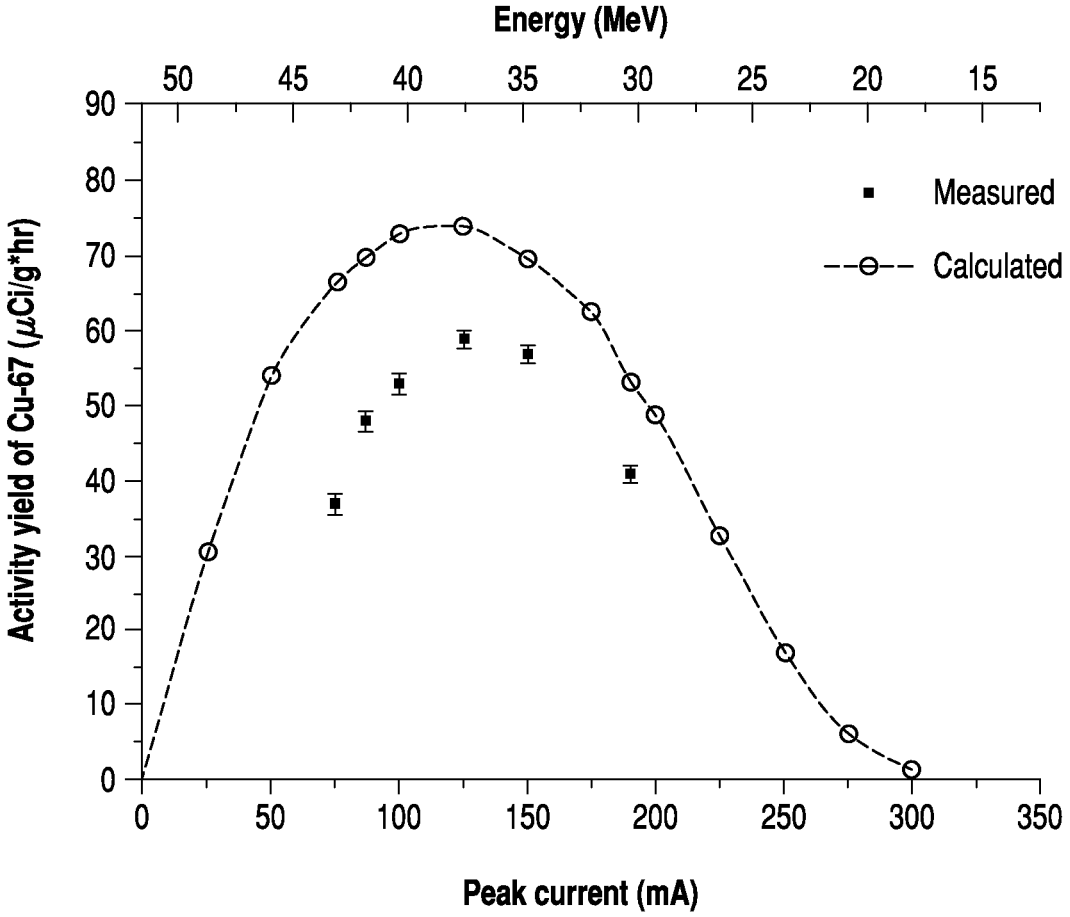
FIG. 3 illustrates a graphical representation of a relationship between the photo-yield of copper-67 and the electron beam energy (MeV) or electron beam current (microAmps).

Seen in FIG. 3, taking into account that at higher energies, the photo-produced copper-67 yield does not increase linearly with increase in electron energy, and considering the load characteristics of a pulsed electron linac, it may be possible to operate the electron linac in an optimal energy range for an optimal irradiation time. In one embodiment, the optimization may be done to produce a yield of copper-67 suitable for medical applications. For example, a cylindrical zinc-68 target that is about 2.5 cm in diameter, about 2.8 cm in length, and with one end of the cylindrical target facing the converter plates (converter plates 16 in FIG. 1A), a peak beam current may be calculated using a beam load function for different beam energies. Assuming an average duty factor of 0.1%, which is the fraction of time the beam is "on," the average beam current and average beam power may be determined from the peak beam current for a given electron beam energy. For example, at 40 MeV of loaded beam energy, the peak beam current is 104 microAmps. Considering 0.1% duty factor, the average current is 104 microAmps. For these given electron beam parameters, the average power was found to be: $P_{avg}$=40 MeV×104 microAmps×0.1%=4.16 kW. Accordingly, the average power of an electron beam striking a converter for the photonuclear conversion of zinc-68 to copper-67 may likely be in the range of 3 kW to 8 kW.

A MCNPX simulated photon flux through a 40 g cylindrical zinc-68 target may be used to calculate the average activity yield of copper-67 at various beam energies and corresponding beam currents. Photon activations on zinc targets may be performed at various beam energies followed by gamma spectroscopy. The optimal current and energy of electron beam may be determined based on the highest activity yield of copper-67. According to the measured activity values, optimal beam energy for the photo-production of copper-67 may be about 38 MeV. The values may be compared or measured against Monte Carlo simulation results to determine their agreement.

Using Monte Carlo simulations, the optimum photon flux in a 40 g cylindrical zinc-68 target, the heat deposition in the target, as well as the converter with an electron beam of 40 MeV energy at 25 microAmps average beam current using several different converter designs and various thicknesses, may be investigated. For example, the optimum photon flux yield may peak using a 1.5 mm thick converter and gradually drop with increasing thickness of the converter. An increase in the converter thickness may also result in a corresponding decrease of the energy (heat) deposited into the target. However, there may exist a relationship between photon flux, converter design and thickness, and heat generation in the target. For example, an increase in the thickness of the converter from 1.5 mm to 4.5 mm may cause the optimum photon flux to decrease by about 18% with a corresponding 41% drop in the energy generation within the target. Considering the possible melting of a target posed by large amounts of heat generation some yield of copper-67 may be forgone in exchange for lower heat generation.

Figure 4:
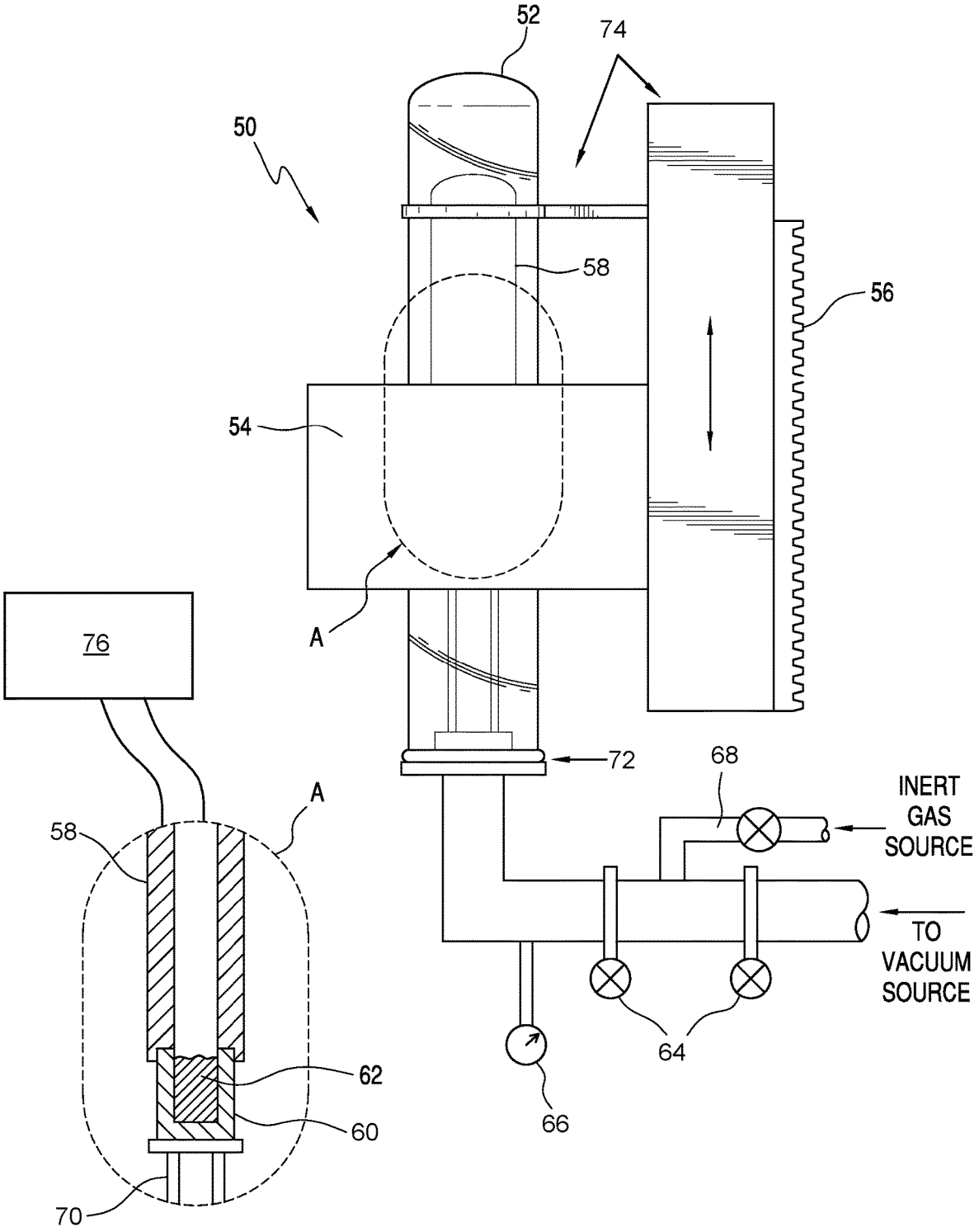
FIG. 4 illustrates a view of a sublimation apparatus used to separate and purify inorganic solids.

As represented by FIG. 4, following the gamma irradiation of the target (metal target 27 in FIG. 1A) and allowing sufficient time for some of the relatively short-lived radioisotopes of copper to decay to near background levels, the target may be positioned in a sublimation apparatus 50. Sublimation apparatus 50 may include sublimation vessel 52, heating element 54, and translation stage 56 to vertically position heating element 54 and sublimation vessel 52 relative to the position of collection vessel 58 and crucible 60 containing solid mixture 62. Sublimation apparatus 50 may also include vacuum port valves 64, vacuum gauge 66, and inert gas port 68.

After sublimation apparatus 50 is assembled, sublimation vessel 52 may be evacuated and back-filled with an inert gas, for example, argon, using inert gas port 68. Similarly, helium or nitrogen may be used. The purge/vacuum cycles, through vacuum port valves 64, may be used to remove trace levels of oxygen in sublimation vessel 52 prior to heating in order to minimize oxidation of zinc-68 to a zinc-68 oxide. Within the interior of sublimation vessel 52 is solid mixture 62, which as shown, is contained within crucible 60. Crucible 60 may be supported in sublimation vessel 52 with support 70. Positioned above crucible 60, and hence above solid mixture 62, is collection vessel 58.

Sublimation vessel 52, as depicted, is represented as a cylindrical hollow tube, and may be made of quartz, though sublimation vessel 52 may similarly be made of a metal, e.g., titanium, or a ceramic oxide. In one embodiment, an advantage of making sublimation vessel 52 out of quartz is that an infra-red detector may be used to measure the temperature of collection vessel 58 during the sublimation heat cycle. The monitoring of and, if necessary, adjustment to, the temperature of the collection vessel 58 may optimize the fill efficiency of the target metal within the internal volume (discussed later) of collection vessel 58 during the sublimation heat cycle.

In the sublimation of a solid mixture 62 containing zinc-68, or another target metal, copper-67 and other trace metals, for example, zinc-68 may have a greater vapor pressure than that of copper-67 at a given temperature and pressure. Accordingly, in the described sublimation process, the zinc-68 of solid mixture 62 may be selectively converted into the vapor phase upon heating by heating element 54. The zinc-68 may then condense in sublimation apparatus 50, and the copper-67, and optionally other trace metals, are retained in solid mixture 62. In one embodiment, an advantage to the separation process described herein is the manner in which zinc-68 may condense from solid mixture 62 within sublimation vessel 52.

Under most sublimation conditions for a given temperature and pressure, at least about 95% or 98% or greater of the zinc-68 may be removed from the solid mixture by sublimation. For example, at least about 99.9%, even at least about 99.99%, on a weight basis of the zinc-68 in solid mixture 62 may be separated by sublimation. The copper-67 that remains in the solid mixture 62 may be further purified by chemical means, for example, by dissolving solid mixture 62 in an aqueous inorganic acid to form an acidic solution of metal ions. The copper-67 may then be separated from other trace metals by a metal-ion exchange. The zinc-68 sublimate may thereafter be recycled for use in another enriched target, and the process of producing copper-67 may therein be repeated, as discussed previously.

Alternatively, copper-67 produced in the gamma irradiation of a zinc-68 target may be separated from solid mixture 62 at temperatures in the range of about 400° C. to about 700° C. in an environment of reduced pressure. The environment of reduced pressure in sublimation apparatus 50 may be created under a dynamic vacuum, using vacuum port valves 66, rather than static vacuum. However, it is understood that either type of vacuum may be used. Also, an exemplary range of pressures of the evacuated sublimation vessel 52 may be about 1 mbar or less (e.g., about $10^{-6}$ mbar). Using vacuum gauge 68, the pressure may be determined.

Figure 5:
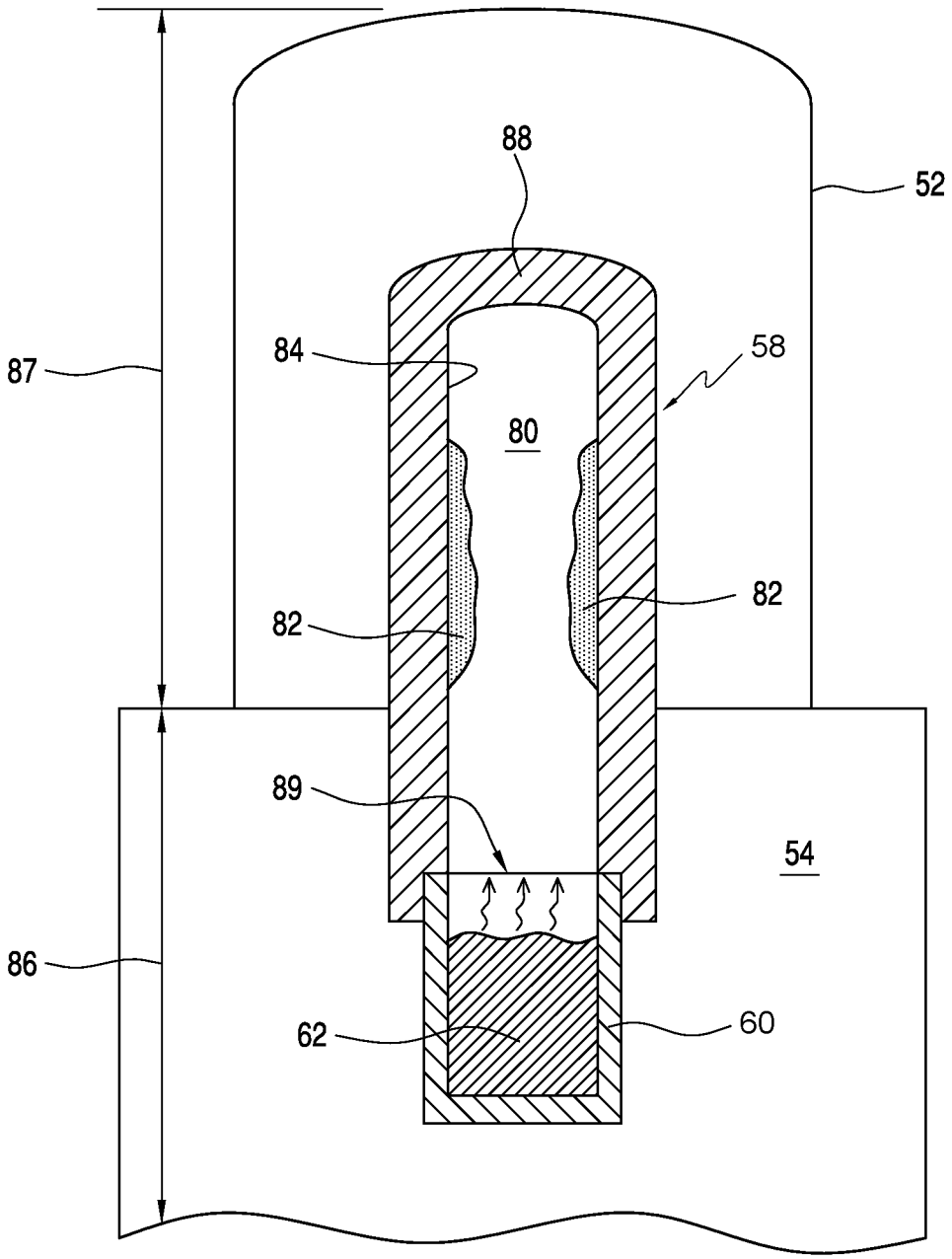
FIG. 5 illustrates a cross-sectional view of a one-piece collection vessel positioned within a sublimation apparatus.

Collection vessel 58, as depicted in FIG. 4, subpart A, and in FIG. 5, may be described as a one piece or multiple-piece unit vessel (each being described herein) that defines an internal volume of any shape, for example, a cylindrical or cone-shaped vessel that fits within sublimation vessel 52. Collection vessel 58 may be used as a receptacle in which sublimed metal vapors from a heated solid mixture may condense.

As stated above, sublimation apparatus 50 may include translational stage 56 to position sublimation vessel 52, and optionally, heating element 54 to a location over crucible 60 and collection vessel 58. Once the components of sublimation apparatus 50 are in appropriate positions, sublimation vessel 52 may be secured and sealed. This may occur, for example, by using a high vacuum O-ring 72, located at the bottom of the sublimation vessel 52 and a vacuum source (Indicated in FIG. 4). Following the heating step of the process, translational stage 56 may also be used to move sublimation vessel 52, and optionally, heating element 54, away from collection vessel 58 and crucible 60 that contains the remaining solids of solid mixture 62. For example, translational stage 56 may be in a vertical relationship to the sublimation vessel 52, via a sublimation support assembly 74, such that the stage in connection with sublimation vessel 52 may both lower and raise sublimation vessel 52 over collection vessel 58 and crucible 60. Moreover, translational stage 56 may be in connection with heating element 54 to lower and raise heating element 54 over collection vessel 58 and crucible 60.

Sublimation apparatus 50 may further include a control unit 76 that receives or monitors temperature data of solid mixture 62, crucible 60 that contains solid mixture 62, support 60, and pressure data, through vacuum gauge 68, within sublimation vessel 52. For clarity, the lines between control unit 76 and subpart A indicate that the control unit 76 is in data communication with the sublimation apparatus 50. Such communication, for example, may be through hardwire or wireless sensors (not shown) providing the data. Based on the given temperature data, the control unit 76 may also be used to automatically adjust the operating temperature of heating element 54, and thereby adjust the temperature of solid mixture 62 as well as at least a portion of collection vessel 58. The control unit 76 may receive temperature data of collection vessel 58. The ability to adjust and maintain temperature of the different components, e.g., solid mixture 62 or collection vessel 58, during sublimation may help prevent or minimize the formation of a zinc-68 "plug" in the lower half of collection vessel 58 before a significant portion of zinc-68 metal is sublimed from solid mixture 62. Accordingly, the temperature of the various components may be controlled so to control the condensation rate of the metal vapor within collection vessel 58.

FIG. 5 illustrates a cross-sectional representation of collection vessel 58 that may be used as a receptacle for collected condensed vapors of zinc-68 from solid mixture 62 when heated by heating element 54 to an appropriate temperature and environment of reduced pressure within sublimation vessel 52.

Collection vessel 58 is depicted as a cylindrical form that fits within sublimation vessel 52, which happens to have a cylindrical form. Although both the collection vessel 58 and the sublimation vessel 52 are depicted as cylindrical in shape in FIG. 5, one vessel shape may be independent of the other vessel shape. Stated another way, collection vessel 58 and sublimation vessel 52 need not have identical nor similar shape, and may have very different shape forms that define different internal geometric volumes.

As shown, collection vessel 58 may have an internal volume 80 with internal sidewall 84, on which sublimed metal vapor may condense. As a metal vapor flows into the internal volume 80, the metal vapor passes along the vessel and eventually contacts a relatively cool internal sidewall 84 of collection vessel 58 and condenses along internal sidewall 84 to form sublimed metal 82. During the heat stage of the sublimation process, collection vessel 58 is positioned within both heat volume portion 86 and warm volume portion 87 of sublimation vessel 52. The temperature of the heating element 54 is maintained at a temperature that may allow the metal vapor to condense within collection vessel 58 at a rate that does not clog a lower portion of collection vessel 58 with sublimed/condensed metal 82 with significant amounts of target metal yet to be sublimed in solid mixture 62. Accordingly, there exists an optimal temperature at which to maintain heating element 54, and, the temperature along the length of internal volume 80 of collection vessel 58.

Condensed metal 82 may further be prevented from traversing downward on the internal sidewall 84 via adhesion with internal sidewall 84 and tension within the condensed metal 82.

As shown, collection vessel 58 may include an upper end 88 and opposite, open end 89, with internal sidewalls 84 extending from upper end 88 to opposite open end 89, thereby forming internal volume 80 of collection vessel 58, wherein vapor of the target metal may condense upon internal sidewall 84. For example, collection vessel 58 may have internal volume 80 of sufficient size to hold 10 g to 1 kg of zinc metal.

Also shown, open end 89 may be configured to engage and fit with an open end of crucible 60. The configured fit may not necessarily have to be a tight or a sealed fitting between open end 89 and crucible 60. However, the snugness of the fit may minimize the escape of sublimed metal 82 into a volume of sublimation vessel 52 before the vapor has an opportunity to move up collection vessel 58 and condense within internal volume 80.

In metal-metal separations using the described sublimation process, at least one metal to be sublimed from a solid mixture may have an appreciable vapor pressure at a temperature from 300° C. to 700° C. at a nominal pressure of $10^{-5}$ mbar within sublimation vessel 52.

Collection vessel 58 may have internal sidewalls 84 that are cylindrical, as depicted in FIG. 5, or may be shaped as a truncated cone, or flat or scalloped elongated segments that combine to form geometric volume 80. Collection vessel 58 may be made of any material that is thermally stable to temperatures of at least about 800° C. For example, suitable materials may include a metal such as titanium, a ceramic oxide that is stable at temperatures greater than 600° C., or graphite. In one embodiment, graphite may be a material of particular interest because of its inherent lubricity and thermal stability. One advantage of collection vessel 88 being made of graphite is that condensed metal 82, and in particular, condensed zinc-68, may more easily be removed from internal volume 80. Particularly, the condensed zinc-68 may be recovered from collection vessel 58 by sliding collection vessel 58 off of condensed metal 82, thereby leaving a zinc-68 target slug that is easily refitted, e.g., by melting into a crucible and positioned back into a target assembly for irradiation. Following irradiation, the sublimation process may be repeated and again the condensed zinc-68 slug may be returned to the target assembly 10 or 10B. To make the final conversion of zinc-68 to copper-67 more efficient, any number of repeated irradiation and recovery cycles are possible, which may make the process efficient in terms of final conversion of zinc-68 to copper-67.

Crucible 60 may be made of materials that are stable at high temperatures. For example, suitable materials for crucible 60 may be materials stable at temperatures to at least about 900° C. including, but not limited to, a ceramic oxide, a metal, or graphite. Crucible 60 may also be used to shape the enriched zinc-68 shot into a select geometric form of the zinc-68 target. For instance, the commercial shot of zinc-68 may be placed in crucible 60 and therein positioned in a melt furnace, or an alternative environment that may be purged of trace amounts of oxygen to minimize the formation of zinc oxide during the melt stage. As shown in FIG. 5, crucible 60 is a high temperature stable cup with an open end and an opposite closed end. Like a cup, crucible 60 may adopt a cylindrical form or any geometric form including a truncated cone form.

In many instances, the geometric volume form of the zinc-68 target may adopt the interior geometric volume form of crucible 60, if the same crucible is used to both prepare the target and contain the zinc-68 target in a target assembly. Further, in some instances, crucible 60 may include any number of exterior cooling fins (not shown) to facilitate the cooling of the zinc-68 target during the irradiation.

Following the sublimation of zinc-68 from solid mixture 62, the copper-67 residue that remains in crucible 60 may be isolated from other trace metals by dissolution in an acid (e.g., a mineral acid such as sulfuric acid, hydrochloric acid, phosphoric acid, nitric acid, or a combination of mineral acids), followed by ion exchange with a selective copper ion exchange resin (e.g., a quaternized amine resin) or a chelating agent immobilized on an ion exchange resin or silica substrate. In one embodiment, the copper-67 residue may be dissolved in hydrochloric acid and the resulting aqueous solution passed through a quaternary amine ion exchange resin. The non-copper trace metals in the acid solution may pass through the column at a very low pH. After passing through a low pH aqueous solution, the pH of the flush solution is raised to release the copper from the exchange resin. The collected solution is thereafter evaporated to dryness, leaving a copper-67 radioisotope. In one embodiment, the copper-67 left may be suitable for shipment, or for molecular complexation as a radiopharmaceutical for medical or research applications.

Figure 6:
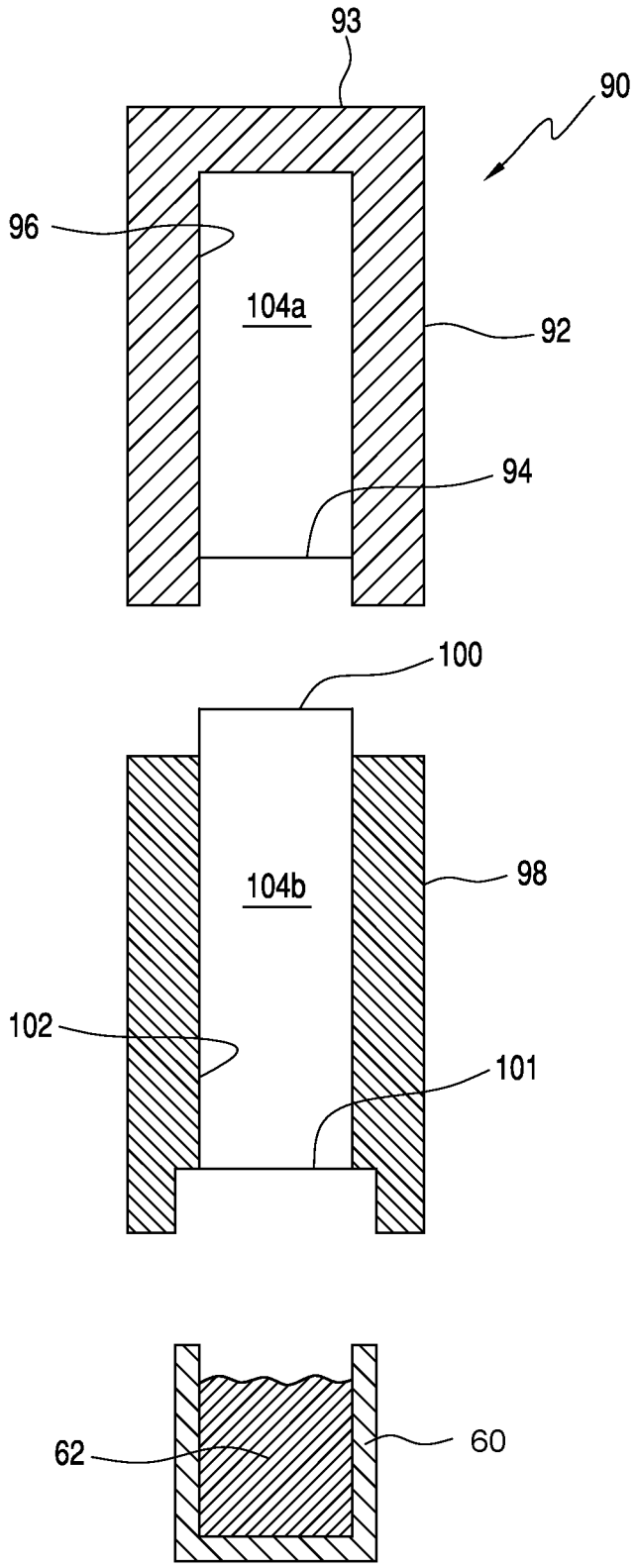
FIG. 6 illustrates a cross-sectional view of a two-piece collection vessel positioned within a sublimation apparatus.

Illustrated in FIG. 6 is a cross-sectional representation of collection vessel 90 that includes two separable portions including a first portion 92 having a first upper end 93, which may be a closed end, and an opposite, first open end 94. First portion 90 may include first internal sidewall 96 extending from first upper end 93 to opposite, first open end 94. Second portion 98 of collection vessel 90 may include a second, upper open end 100 configured to engage and fit with opposite, first open end 94 of first portion 92. Second portion 98 may also include an opposite, second open end 101, and second internal sidewall 102 extending from second, upper open end 100 to second, opposite open end 101. If combined in an elongated manner, first internal sidewall 96 and second internal sidewall 102 may define first internal volume 104*a* and second internal volume 104*b*, respectively, forming collection vessel 90.

A multiple-piece collection vessel 90, as shown in FIG. 6, may have any number of divided portions. For example, a collection vessel may have six portions that extend from a portion proximate to the crucible and a portion proximate to the closed end of the sublimation vessel. FIG. 6 exemplifies and describes a two-piece collection vessel. In one embodiment, the advantage of dividing collection vessel 90 into at least two portions may be to facilitate the removal of the condensed metal that forms within the internal volume 104*a* and 104*b* of multiple-piece collection vessel 90.

The following examples, while, in addition to referring to the subsequent figures, are put forth so as to provide a complete disclosure and description of how the articles and methods described and claimed are made and evaluated. They are intended to be purely exemplary and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C., or if not stated, the temperature at which the experiment or measurement is conducted is about room temperature. Pressure is at, or near, atmospheric unless stated otherwise. There are numerous variations and combinations of reaction conditions, e.g., component concentrations, desired solvents, solvent mixtures, temperatures, pressures and other reaction ranges and conditions that may be used to optimize the product purity and yield obtained from the described process.

Example 1: Fresh Sample

Figure 11:
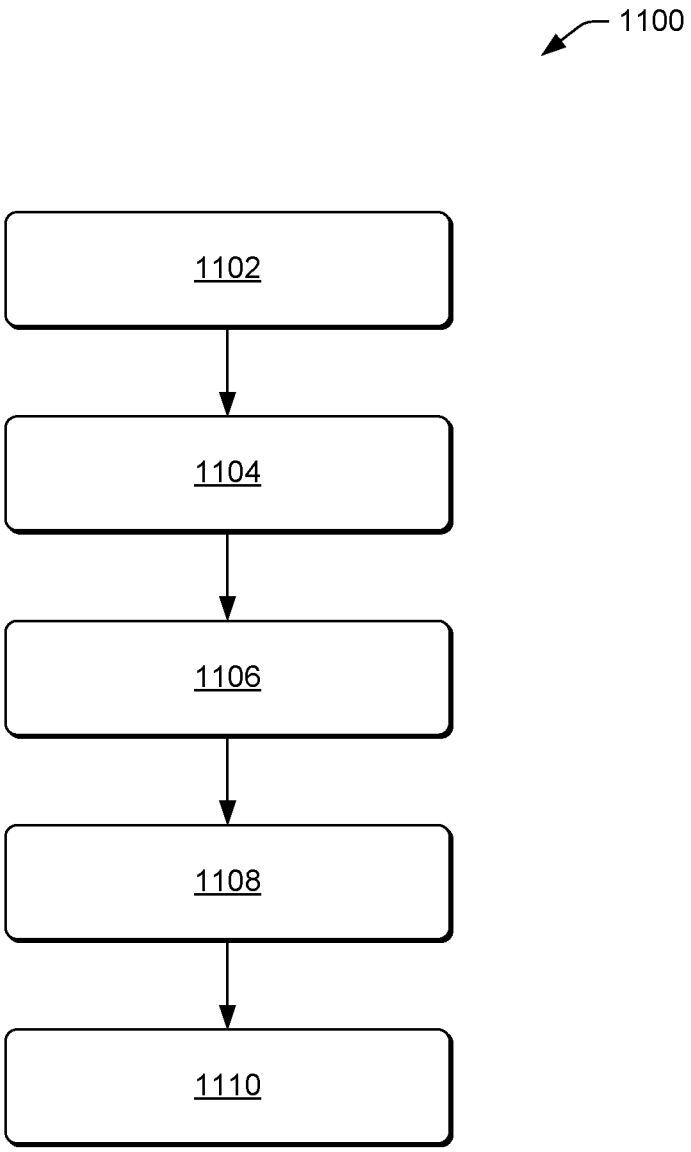
FIG. 11 illustrates a method of irradiating a metal target.

Referring to FIG. 11, which shows a method 1100 of producing an irradiated metal target. For example, to prepare a sample zinc-68 target, about 40 g of about 98% to about 99% enriched zinc-68 may be melted into an alumina ($Al_2O_3$) crucible, as an example of step 1102. Alumina is one of many select materials that may be used as a crucible material because of its hardness, low porosity, and high melting point (2072° C.). The crucible may thereafter be positioned within a tube furnace having an 8 inch hot zone with a 2 inch diameter alumina casing for fully enclosing a slightly smaller diameter furnace tube. An inert gas line may connect to one end of the furnace tube. During the heat or melt cycle of the enriched cycle, the crucible may be blanketed in argon to minimize oxidation of zinc. The target may therein take the form of the crucible. The furnace tube may be cycled under vacuum to 20 to 30 mbar and flushed with argon for at least two cycles prior to heating the furnace tube.

A high quality zinc target (i.e., natural refined zinc to remove metal contaminants to 99.9999% zinc or better) or a 98% or better enriched zinc-68 target may be melted into an approximately 7 mL volume alumina (98% $Al_2O_3$ by weight) crucible with an approximate outside diameter of 25 mm. In one embodiment, it may be advantageous if the resulting zinc "slug" inside the crucible is essentially free of voids or there is little or no zinc oxide (ZnO) coating or ZnO embedded in the slug. To minimize the amount of ZnO in the target crucible, the zinc melt may be poured into the crucible through a specially designed funnel at a temperature between about 500° C. and about 550° C. Pouring may also occur in an argon blanket environment. The funnel may be made of graphite and may be about 7 cm long, 3.5 cm in diameter, and have an orifice of approximately 5 mm in diameter. The design of the funnel, and in particular the orifice, may minimize the incorporation of ZnO from entering the target crucible. Instead, the ZnO may float on top of the zinc melt in the funnel as the zinc slowly fills the crucible from the orifice. Thereafter the ZnO may be collected on the angular surface of the funnel, removed, and may be refined by sublimation to recover additional zinc-68 material.

After being positioned in a target assembly, step 1104, and directing an electron beam at converter plates, step 1106, the metal target may be irradiated using a 48 MeV, 10 kW electron linac in step 1108. The alumina crucible containing the zinc-68 target obtained from the melted shot may be positioned a few centimeters, e.g. from 3 cm to 6 cm, from the last converter plate. The converter plates may comprise three water-cooled tungsten plates in series, each having a thickness of 1.5 mm and separated from one another by 3 mm. See FIG. 1, for example. Accordingly, cooling the converter plates in step 1110 may help remove heat generated during irradiation. Fast moving electrons from the linac may then strike the converter plates and produce Bremsstrahlung photons as the electrons decelerate within the series of converter plates. The zinc-68 target may irradiate with Bremsstrahlung photons for 1 hour to 260 hours, 1 hour to 180 hours, 1 hour to 80 hours, or 5 hours to 60 hours. Following the irradiation of the target, in a further embodiment, the target may be retained in the target assembly for a time sufficient for the short-lived radioisotopes to decay to background level so that the radiation exposure to working personnel is in agreement with safety limits. To determine if sufficient copper-67 is produced within the zinc-68 target, the irradiated target may be analyzed for activity of various radioisotopes using a photon spectrometer.

Different dimensions and masses of a cylindrical zinc target may be investigated. The radius to length ratio of the cylinder that produces the highest activity yield of copper-67 was assessed by comparing results for all possible values of radius.

Figure 7:
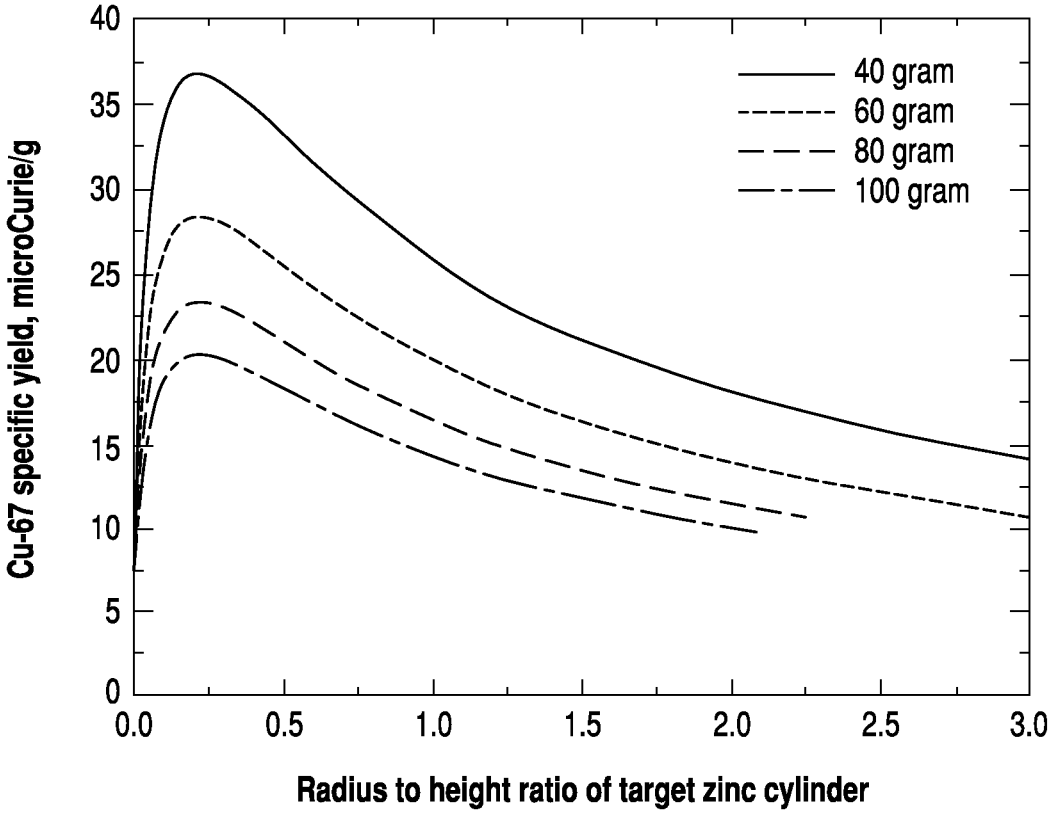
FIG. 7 illustrates a graphical representation showing a relationship between the photo-yield of copper-67 and a radius to length ratio of a zinc-68 target.

FIG. 7 illustrates a plot that describes the radius to length ratios for 40, 60, 80, and 100 g zinc-68 targets and corresponding copper-67 activity yields. As illustrated, the optimized radius and length for a 40 g zinc target may be found to be 0.8 cm and 2.8 cm respectively. Moreover, the optimal radius to length ratio for a cylindrical target may be about 0.18 to about 0.32 for many mass targets at the given electron energy and electron beam energy of 40 MeV and 1 kW, respectively. For example, it may be advantageous to prepare a zinc-68 target with a radius to length ratio in the range of 0.18 to 0.25. Alternatively, the optimal radius to length ratio may change with a corresponding change in electron beam operational parameters.

In one embodiment, for the electron linac used in the photo-production of copper-67, an optimum electron beam energy may be from about 38 MeV to about 42 MeV. In order to maximize the Bremsstrahlung photon yield, while minimizing the zinc target heating, different converter thicknesses may be used. The converter geometry may be found to have three tungsten discs, each with a thickness of 1.5 mm and separated from one another by 3 mm. For example, for a 40 g zinc-68 target cylinder having a radius of 0.8 cm and a length of 2.8 cm in length and an electron beam of 38 MeV, the estimated activity of copper-67 is 16 μCi/g-target-kW-hr. Experimentally, for a cylindrical zinc target of radius 0.9 cm and length of 2.2 cm, the measured copper-67 activity may roughly be 12.4 μCi/g-target-kW-hr. Generally, it may be discovered that the experimentally measured values for the activity of copper-67 is about 20-30% less than the Monte Carlo simulated values.

Following the irradiation of the zinc-68 target described herein, (as in method 1100 of FIG. 11) to allow high energy short-lived radioisotopes to decay to safe levels for handling, the target holder may be removed from the target assembly and placed in a lead pig. A sheet of lead glass may be positioned in front of the lead pig. After a minimum of 30 minutes, using laboratory tongs, the target holder containing the target crucible may be removed.

Figure 12:
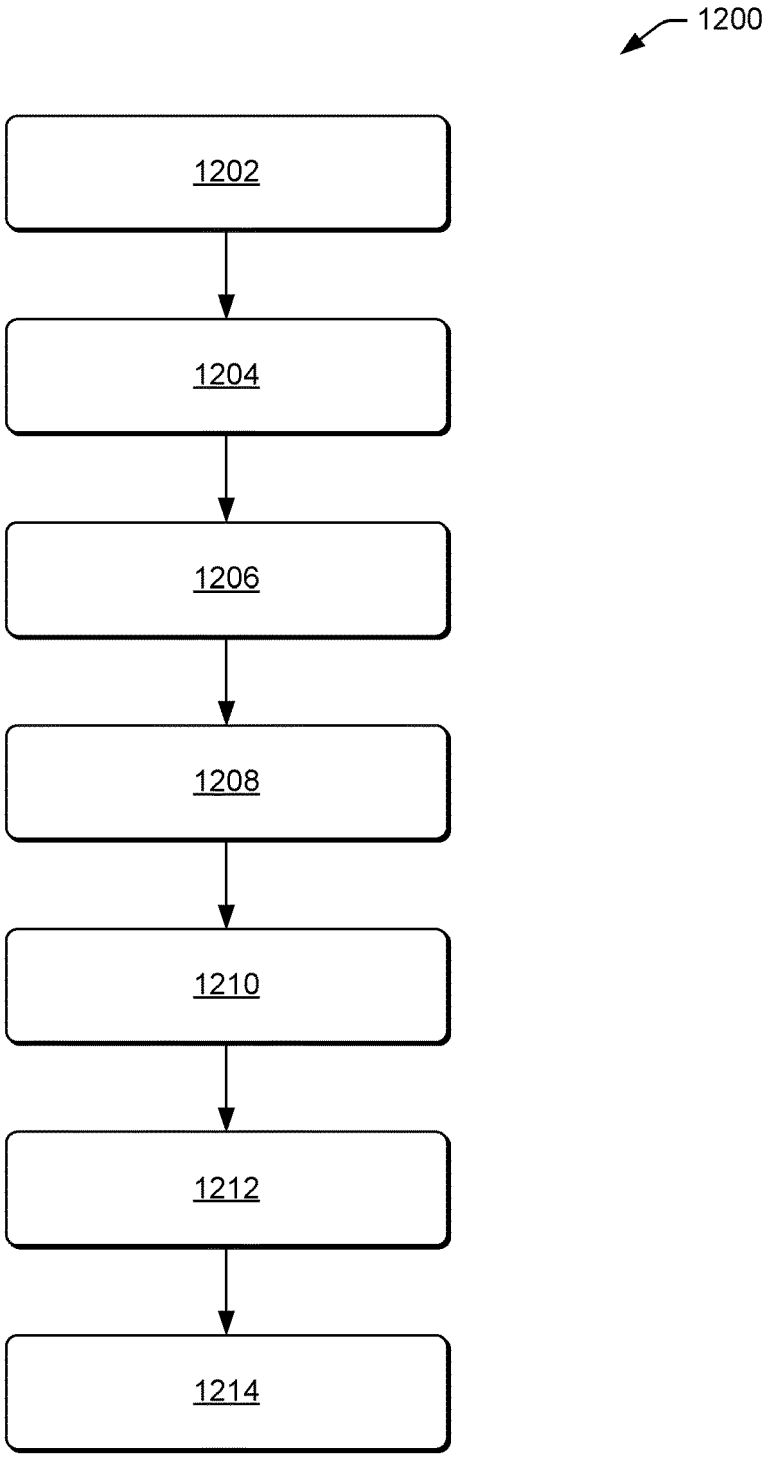
FIG. 12 illustrates a method of separating copper-67 from an enriched zinc-68 target.

Shown in FIG. 12, and method 1200, the target crucible may thereafter be removed and positioned on the support stand of a sublimation apparatus in step 1202. Once a two-piece collection vessel is positioned atop the target crucible, and subsequently a crucible stand, a crucible, collection vessel, and a stepper motor controller may be used to lower the heating element and an attached quartz sublimation vessel over the collection vessel and supported crucible, as in step 1204. The sublimation vessel may be lowered until a lower open end of the vessel contacts an O-ring on the vacuum assembly. A mechanical vacuum pump may be used to achieve a vacuum of about 2 mbar, at which time, a vacuum turbo pump may be used to lower the pressure to less than $1\times10^{-4}$ mbar, as in step 1206. The vacuum system may be checked for leaks by closing the inlet valve to the turbo pump and verifying the vacuum leak rate is less than a certain rate, for example, $1\times10^{-2}$ mbar/min.

A furnace control program controlling the heating element, may thereafter be initiated to bring the furnace temperature to 150° C., as in step 1208. While the furnace temperature is maintained at 150° C., the vacuum valve to the turbo pump is closed, and the sublimation vessel is purged with argon. The argon valve is then closed and the vacuum opened to reapply a vacuum of about 2 mbar to the sublimation vessel. The argon/vacuum process may be cycled 3 times to remove trace amounts of oxygen gas within the sublimation vessel. Following the third purge cycle, or subsequent cycles, the valve to the turbo pump is opened and the pressure is reduced to less than $1\times10^{-4}$ mbar. Again, the leak rate of vacuum may be verified to be less than $5\times10^{-3}$ mbar/min. Additionally, it is contemplated that pressure may be monitored within the collection vessel and/or the sublimation vessel.

Thereafter the furnace control program brings the temperature of the furnace to 600° C. and maintains such temperature during the heat cycle. For example, the sublimation run may increase the temperature from 150° C. to approximately 600° C. at a ramp rate of 6 degrees per minute. The rate may be adjustable so as to not crack the components of the apparatus depending on the choice of materials. For example, increasing temperature at high rates may crack materials made of alumina. However, in one embodiment, materials made of quartz may not be as susceptible to higher rates. The total time of the sublimation heat cycle at 600° C. time is approximately 2 hours and 15 minutes, followed by a rapid cool down, as in step 1210. Starting from a 40 g zinc target, the amount of zinc remaining in the crucible may be less than 20 mg after sublimation. Accordingly, a majority of the zinc may condense within the collection vessel during the heating stage. Additionally, throughout the heat cycle, the vacuum may be monitored to ensure the vacuum is less than $1\times10^{-4}$ mbar. The majority of the zinc may be captured in the collection vessel and thus, may be used to repeat the irradiation process.

Afterward, the vacuum valve is closed and the sublimation vessel is slowly back-filled with argon to raise the system pressure to 0 psi, as in step 1212. In turn, the stepper motor controller of the translation stage may be used to raise the quartz tube above the collection vessel. After removing the collection vessel, it may be set aside for further zinc recovery and copper-67 production runs. The crucible containing the copper-67 may then be removed from the sublimation apparatus.

Approximately 8 mL of concentrated HCl may be added to the crucible and stirred, as in step 1214. After 30 minutes, for example, the concentrated HCl is pumped onto a 10 mL, 1×8 anion exchange column. The column may be washed with approximately 10 mL of 6M HCl to elute non-copper metal ions from the column. The copper ion may then be eluted with 10 mL of 2M HCl. The 2M eluent is dried in a glass shipping vial to less than a 1 mL volume using a heated flowing flow of nitrogen gas.

As indicated, the sublimed zinc-68 may be removed from the collection vessel and may be melted into a new crucible for subsequent photo-generation of copper-67, sublimation, and recovery, for example, by repeating method 1100 and 1200 of FIGS. 11 and 12, respectively. However, each sublimation and crucible re-filling may create some waste zinc that is caught in the pour funnel or escapes due to evaporation onto cooler parts of the melt furnace. The waste zinc may be collected and packed into a crucible or may also be sublimed, melted, and reused in a subsequent irradiation process, for example, method 1100 of FIG. 11. With this recovery process, the total lost zinc per each irradiation/separation/recovery process cycle may be less than 100 mg of zinc-68.

Figure 8:
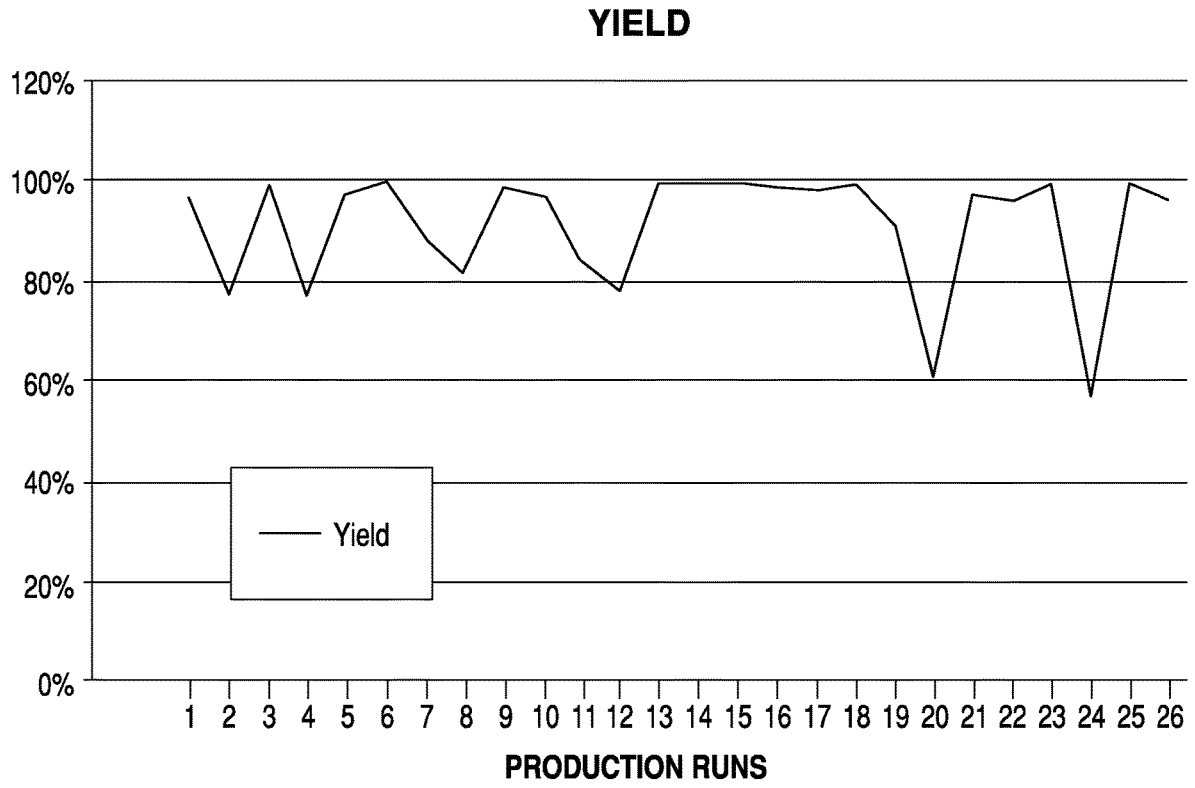
FIG. 8 illustrates a graphical representation showing isolation yields from the sublimation separation stage during multiple production runs for the recovery of copper-67.
Figure 9:
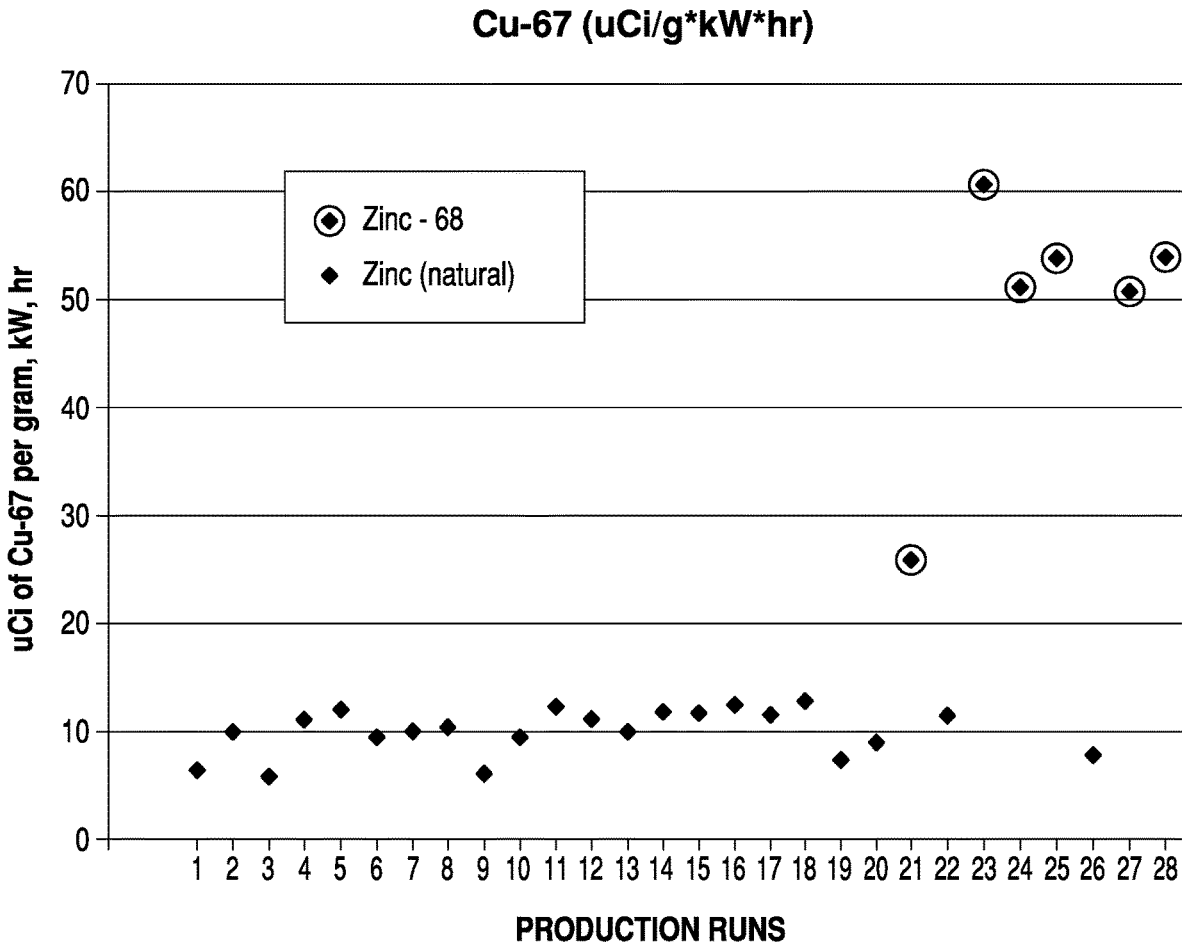
FIG. 9 illustrates a graphical representation of the rate of activity per unit of mass and power for different production runs of natural and enriched Zinc.

Illustrated in FIGS. 8 and 9, experimental production runs may be conducted for the irradiation of a natural zinc target and a zinc-68 target. Particularly, FIG. 8 depicts the isolation yields of the separation stage, i.e., the combined sublimation and chromatography process steps, for the recovery of the copper-67 from the copper-67 in a solid mixture. With the exception of isolated technical issues, the recovery yields may be consistently greater than 90% because the implementation of the funnel fill system with production run number 13 to remove zinc oxide and tight control to prevent contaminants, such as chlorine contacting the zinc. The 60% yields obtained with production runs 20 and 24 may be caused by improper sublimation program or a failed vacuum gasket, respectively.

FIG. 9, shows the rate of activity per unit of mass and power for different productions and type of target irradiated (natural or enriched). The plot shows the expected differences between a natural zinc target and a zinc-68 target. Also, the variation in copper-67 activity created from the zinc-68 target runs may be attributed to changes in distance between the converters whereby the target with longer spacing creates lower activity.

Example 2: Prior Sample

For waste zinc collected from previous sublimation runs, for example in step 1210 of FIG. 12, the zinc-68 may be heated under an argon atmosphere in a tube furnace to form a melt that is poured into an alumina crucible using the described graphite funnel, as in step 1102 of FIG. 11. Specifically, the amount of zinc-68 in the crucible was 36.52 g. The crucible may therein be positioned in the target assembly and irradiated with a calculated average power of 4.125 kW electron beam for 1 hour, as in steps 1104 and 1108 of FIG. 11. Irradiation was stopped, the crucible was placed in a lead pig, and thereafter the crucible was positioned in a sublimation apparatus the next day (about 23 hours later), though a wait time of about 3 to 5 hours may be typical. The sublimation temperature was brought from room temperature to 150° C. in about 8 minutes, the temperature being measured, for example, with a thermocouple positioned on the exterior of the quartz sublimation vessel within the heat zone of the heating element. The temperature of the sublimation vessel was increase by 6° C./min and the solid mixture sublimed at 600° C. for about 2.5 hours, as in step 1208 of FIG. 12. The measured vacuum (dynamic) within the sublimation vessel was maintained at $1.9\times10^{-5}$ mbar and the final leak test revealed a leak rate of $6\times10^{-5}$ mbar/min, as in step 1206 of FIG. 12. After the cool down period, the collection vessel may be removed from atop the crucible. Correspondingly, the sublimed zinc-68 may be removed and collected.

The collected zinc sublimate had a measured copper-67 count of 47 cps. The crucible with the retained copper-67 had a measured count of 3150 cps or a copper-67 activity of about 9000 μCi. Thereafter, 6 mL of 10M HCL may be added to the solids remaining in the crucible and after stirring for 30 min, the HCl solution may be placed atop an ion exchange column, as in step 1214 of FIG. 12. The crucible may then be washed with an additional 6 mL of 6M HCl solution and the wash solution added atop the column. A 2M HCl solution (12 mL) may be used to elute non-copper metals from the column. Additionally, a 0.001M HCl solution (12 mL) may be used to elute the copper on the column. After drying the eluent solution with a warm nitrogen stream flow, the residue had a measured copper-67 activity of about 9080 μCi, indicating minimal loss from the column purification stage.

Figure 10:
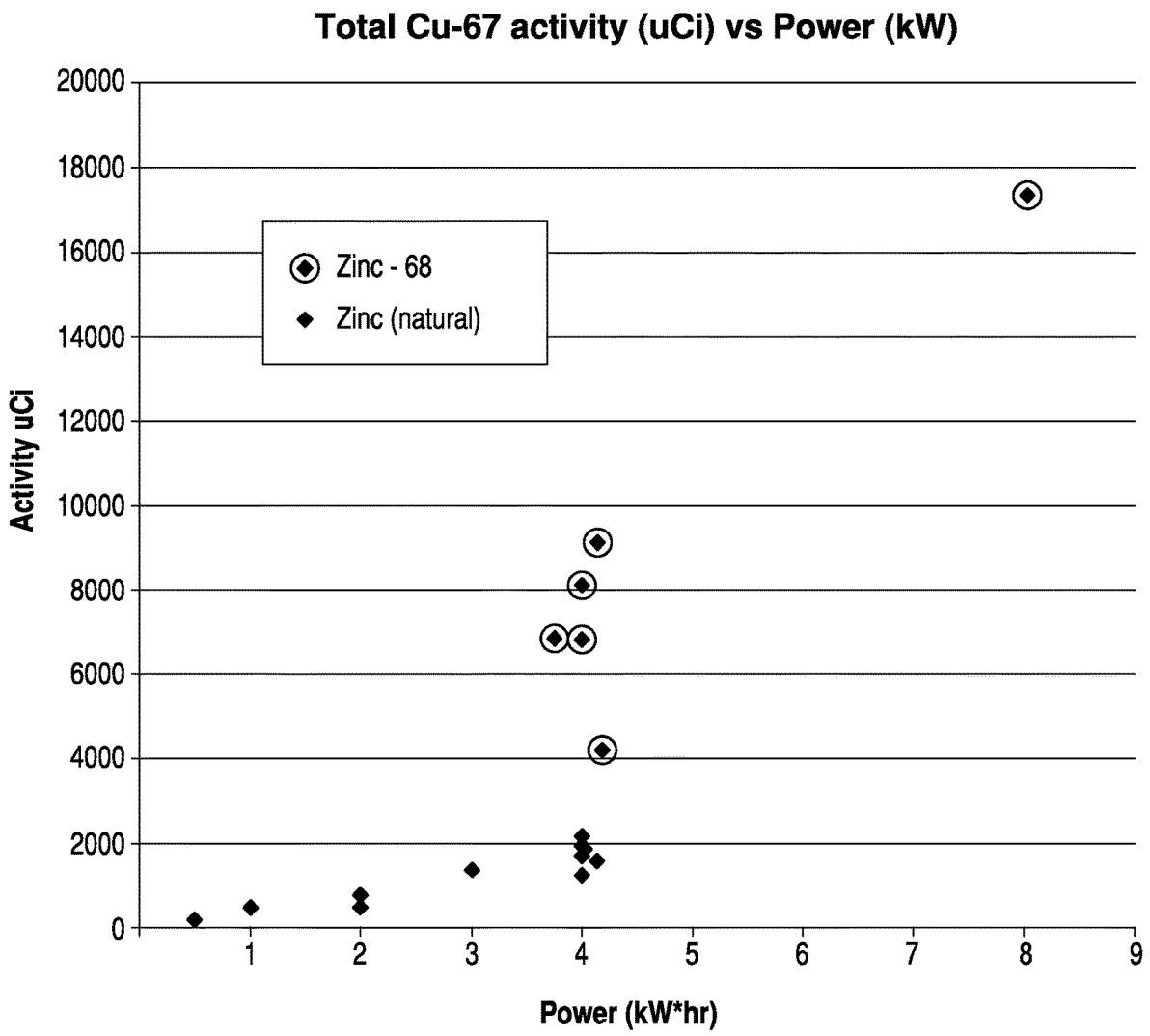
FIG. 10 illustrates total copper-67 activity obtained during a particular average electron linac beam power for different productions runs using natural and enriched Zinc.

Using the irradiation and separation processes described in FIGS. 11 and 12, respectively, FIG. 10 shows the total copper-67 activity for different production runs using different average electron beam power (kW-hr) using either a natural zinc target or a zinc-68 target. As shown, several production runs may be conducted using an approximate 36 g zinc-68 target at an average electron beam power of 4.1 kW for one hour. When using a zinc-68 target, the total activity of copper-67 may range from about 4000 μCi to about 9000 μCi. Also, when using a natural zinc target (about 19% Zinc-68), the total activity of copper-67 may range from about 1200 μCi to about 2100 μCi.

In an additional production run, again using an approximate 36 g zinc-68 target, the irradiation time may be increased to two hours, essentially doubling the power or energy used to irradiate the target. As shown, when the electron beam power was increased to about 8.2 kW-hr, a total copper-67 activity of about 17,400 μCi may be obtained.

It should be noted that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that throughout the application, data is provided in a number of different formats, and that this data, represents endpoints and starting points, and ranges for any combination of the data points. For example, if a particular data point "10" and a particular data point "15" are disclosed, it is understood that 10 and 15 are considered disclosed. It is also understood that each unit value between two particular unit values are also disclosed. For example, if 10 and 15 are disclosed, then 11, 12, 13, and 14 are also disclosed.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A method, comprising the steps of:

positioning a solid mixture including copper-67 and zinc-68 in a sublimation apparatus, the sublimation apparatus including:

a heating element, a sublimation vessel comprising quartz disposed adjacent the heating element such that the heating element heats a portion thereof, a collection vessel removably disposed within the sublimation vessel, and a crucible containing the solid mixture therein and being configured to position the solid mixture in fluid communication with the collection vessel; and heating the solid mixture and thereby forming a metal vapor having greater than 90% by weight zinc-68, wherein the metal vapor flows to and condenses within the collection vessel and a solid residue comprising at least a portion of the copper-67 remains in the crucible.

2. The method of claim 1, wherein the zinc-68 of the heated solid mixture has a greater vapor pressure that that of the copper-67 of the heated solid mixture.

3. The method of claim 1, further comprising placing and maintaining the sublimation apparatus under a vacuum during the step of heating the solid mixture.

4. The method of claim 1, further comprising, after the step of heating the solid mixture, backfilling the sublimation vessel with an inert gas and raising a pressure of the sublimation apparatus.

5. The method of claim 4, further comprising, after the step of backfilling the sublimation vessel with an inert gas, mixing the solid residue remaining in the crucible with an aqueous organic acid to form an acidic solution comprising metal ions including copper-67.

6. The method of claim 5, further comprising purifying the copper-67 of the acidic solution.

7. The method of claim 1, further comprising recycling zinc-68 of the metal vapor as a metal target for production of additional copper-67.

8. The method of claim 1, the collection vessel comprising graphite.

* * * * *